United States Patent [19]

Wagener et al.

[11] 4,322,269

[45] Mar. 30, 1982

[54] METHOD FOR THE WET QUENCHING OF COKE

[75] Inventors: Dietrich Wagener; Claus Flockenhaus; Manfred Blase, all of Essen, Fed. Rep. of Germany

[73] Assignee: Didier Engineering GmbH., Fed. Rep. of Germany

[21] Appl. No.: 263,354

[22] Filed: May 14, 1981

Related U.S. Application Data

[62] Division of Ser. No. 112,439, Jan. 16, 1980, Pat. No. 4,289,585.

[30] Foreign Application Priority Data

Apr. 14, 1979 [DE] Fed. Rep. of Germany ..... 2915330

[51] Int. Cl.[3] ..... C10B 39/08

[52] U.S. Cl. ..... 201/39

[58] Field of Search ..... 201/39; 202/227, 95, 202/253

[56] References Cited

U.S. PATENT DOCUMENTS

| | | | |
|---|---|---|---|
| 1,848,818 | 3/1932 | Becker | 201/39 |
| 4,263,099 | 4/1981 | Porter | 202/227 |
| 4,284,478 | 8/1981 | Brommel | 202/227 |

FOREIGN PATENT DOCUMENTS

| | | | |
|---|---|---|---|
| 2120305 | 11/1972 | Fed. Rep. of Germany | 202/227 |
| 45-28302 | 9/1970 | Japan | 202/227 |

*Primary Examiner*—Bradley Garris

*Attorney, Agent, or Firm*—Wood, Herron & Evans

[57] ABSTRACT

A method and apparatus for the wet quenching of coke is disclosed wherein hot coke is sprayed from above with quenching water, the steam generated by the heat of the coke is condensed by a spray of condensation water from the top of the quenching tower, and the hot condensate-water mixture is collected at the bottom of the quenching tower and recirculating to the top of the tower where it is sprayed between quenching operations to be cooled by a counterflowing stream of air. The cooled condensate-water mixture is suitable for reuse as the condensation spray water.

4 Claims, 3 Drawing Figures

METHOD FOR THE WET QUENCHING OF COKE

This is a division, of application Ser. No. 112,439, filed Jan. 16, 1980, now U.S. Pat. No. 4,289,585.

BACKGROUND OF THE INVENTION

This invention relates to the wet quenching of coke in coke producing plants and, more particularly, to a method and apparatus for the wet quenching of coke wherein the steam generated in the quenching process is condensed, cooled between quenching operations, and reused.

Known apparatus for the wet quenching of coke includes a quenching tower wherein a quenching car loaded with hot coke is moved into the tower and sprayed from above with water. The steam generated in the quenching operation is then condensed in the quenching tower by a spray of condensation water. The hot mixture of condensate and water is collected in the quenching tower between the upper condensation spray apparatus and the lower quenching water spray apparatus and removed to a collection tank. The collection tank is designed to be a heat exchanger for a heat pump whereby the heat of the hot condensate-water mixture is extracted and utilized for the evaporation of coke plant effluents. The cooled condensate-water mixture is then conducted back into a collection tank where it is reused as the steam condensation water in the quenching operation.

This kind of heat recovery although desirable is often economically impractical because of the relatively high investment costs involved. On the other hand, it is undesirable to let the steam generated in the quenching operation which contains undesirable gases from the hot coke to escape into the surrounding air as in conventional quenching towers. In addition, the large amounts of condensate accumulated in the quenching tower, which may be many times greater than the amount of the quenching water used, cannot be discharged directly from the operation because of its relatively high temperature of about 85° C. As a result, it has heretofore been necessary to provide special apparatus for cooling the condensate, for example, in a heat exchanger even if no recovery of the heat of the condensate was obtained in order to use the cooled condensate-water mixture again as condensate water in the quenching operation.

SUMMARY OF THE INVENTION

It has been among the principal objects of this invention to overcome the problems associated with the prior art methods and apparatus. More specifically, it has been an objective of this invention to provide a method and apparatus for quenching hot coke which prevents the emission of undesirable gases, steam and dust from the coke to the atmosphere, which permits recovery and reuse of the water used in the quenching and condensing process, and which yields effective cooling of large amounts of condensate generated in the quenching process without the need for additional cooling and recovery apparatus.

To this end, in accordance with the principles of this invention, the hot condensate-water mixture resulting from condensation of steam generated in the quenching tower is accumulated and at least a portion of it is recirculated to the top of the tower where it is sprayed into the stack between quenching operations to be cooled by a counterflowing stream of air. The cooled condensate-water mixture is again collected and may then be recirculated for reuse as condensate water spray during a quenching operation. Thus, it may be appreciated that the method and apparatus of this invention provides a process wherein the hot mixture of condensate and water is cooled in the quenching tower between quenching operations thus eliminating the need for investment in additional heat exchange equipment in order to reuse the water. The present invention also provides use the quenching tower during periods between quenching operations thereby making fuller use of the available quenching tower facilities. The condensate-water mixture is thus kept continuously in circulation, that is, the condensate-water mixture is accumulated while the quenching tower is closed and the quenching operation proceeds while during the periods between quenching, the tower is opened and the accumulated hot condensate-water mixture is pumped directly to the top of the tower to be cooled. The undesirable gases generated in the quenching operation are substantially exhausted from the quenching tower before it is opened for admission of the upwardly flowing stream of cooling air so that during the condensate-water cooling operation only small amounts of steam are vented through the top of the tower. Accordingly, the present invention provides a method and apparatus for quenching hot coke wherein the investment for cooling the condensate generated in the quenching operation is insignificant.

These and other objectives of the present invention are accomplished by providing a quenching tower having a quenching water spray system located in the lower portion of the tower above the quenching car containing the hot coke, a condensation water spray system located in the upper portion of the tower to condense the upwardly flowing steam generated by quenching the coke with downwardly falling drops of cool condensation water, and a spray cooling system also in the upper portion of the quenching tower for introducing the hot condensate-water mixture in the form of downwardly falling droplets in a counter-flowing stream of air to be cooled thereby. Collection tanks are provided in the bottom of the tower for collecting the quenching water not evaporated by the hot coke which may then be pumped back to the supply system for the quenching water sprayers with intermediate removal of any entrained solids, if desired. The hot condensate-water mixture is accumulated during the quenching operation and between operations a portion thereof is circulated through the spray cooling apparatus. The amount to be circulated is a function of the cooling capacity of the tower as well as the desired temperature of the resulting mixture of hot and cooled condensate-water mixture. Additional cooling devices may be provided either in the quenching tower or by means of injection of additional cooling air through the wall of the tower. Means are provided for coordinating the opening and closing of the doors to the quenching tower with air outlets at the top of the tower such that when the doors are closed for commencement of the quenching operation, the air outlets are likewise closed; and, conversely, when the doors are opened for commencement of the condensate water cooling step, the air outlets are likewise opened.

The departure of the present invention from the prior art may be appreciated by the fact that the cooling of the condensate-water mixture for reuse in the quenching operation is accomplished by simply returning the mixture to the upper part of the quenching tower with relatively simply equipment thereby eliminating the need for expensive heat exchangers and the like heretofore required. That is, the additional investment required is merely in an intermediate tank used as a collection or settling basin, a pump and a spraying apparatus mounted in the top of the quenching tower.

In one embodiment of the present invention, the stack is laterally offset from the opening into which the quenching car moves and wherein the quenching spray apparatus is located. The stack is connected thereto by means of a transverse shaft located above the quenching water spray apparatus. In this embodiment, a greater space is available providing room for the placement of additional cooling means in the tower, if desired. This arrangement also permits collection of the quenching water separate from collection of the hot condensate-water mixture permitting the elimination or substantial simplification of the apparatus for clarifying the hot condensate-water mixture before cooling. This is particularly advantageous because the spraying of the hot condensate-water mixture for cooling preferably takes place through finer nozzles than are used in the quenching water spray apparatus to achieve finer droplets of condensate and thus more efficient cooling thereof.

In accordance with a further embodiment of the invention, a number of slats are mounted across the tower rotatable on their longitudinal axes such that in one position their edges overlap to form a downwardly inclined collection of plates onto which the downwardly falling condensate-water mixture accumulates and is conducted to a separate collection chamber. The plates are then rotated to lie in a vertical direction to permit the updraft of air therebetween while the collected condensate is sprayed for cooling. This arrangement permits the separate collection of the hot condensate for recirculation in the cooling process.

Other objects and advantages of the present invention will be apparent from the following detailed description of the invention, reference being had to the accompanying drawings.

DETAILED DESCRIPTION OF THE INVENTION

Figure 1:
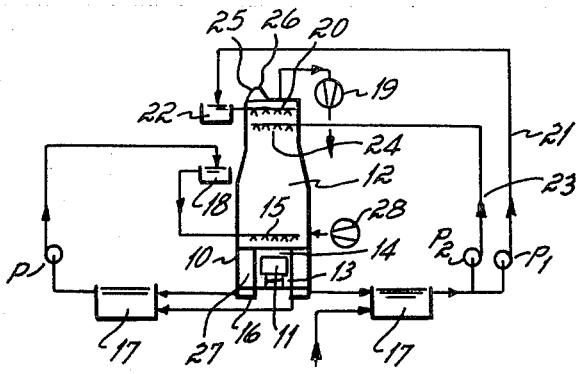
FIG. 1 is a schematic illustration of one embodiment of the invention.

Referring now to FIG. 1, there is shown a quenching tower 10 having an opening 14 at the bottom thereof into which a quenching car travels into and out of, for example, on rails. Above the open area 13 of the quenching tower is a stack 12. The entrance 14 to the interior 13 of the quenching tower 10 includes doors 27 providing an airtight seal for the quenching tower during the quenching operation. The interior 13 of the quenching tower extends directly upward into the stack 12. The gases and steam produced in quenching of the hot coke in the quenching car 11 rise upwardly in the stack. During the quenching process, the interior 13 and the top of the stack 12 are closed to prevent emission of the quenching vapors to the atmosphere.

In the quenching operation, quenching water is sprayed onto the hot coke through an overhead sprinkler 15 located directly above the quenching car 11. The quenching water which is not evaporated in the quenching process is collected in a collection device 16 located at the bottom of the quenching tower 10. The collected water is then fed to one of several intermediate tanks 17 which is used as a settling basin to settle out the dust entrained by the quenching water during the quenching process. From the tank 17, the clarified water is pumped into an elevated tank 18 where it is held for reuse in the quenching of the hot coke through sprinkler system 15.

At the top of the stack 12, the gases produced in the quenching process such as CO, $CO_2$, nitrogen, nitrogen oxides, hydrogen, hydrogen sulfide and the like are drawn off through an exhaust line 19.

The quenching water which is evaporated by the heat of the hot coke in the quenching car 11 rises in the stack 12. The rising steam is condensed by spraying it with condensation water through a sprayer 20 located in the upper portion of the stack 12. The condensate-water mixture is collected in the collection device 16 located in the bottom of the quenching tower 10 and fed to one of the intermediate settling tanks 17 when the coke dust is allowed to settle out.

From the tank 17, a part of the condensate-water mixture is pumped through a line 21 into an elevated tank 22 where it is available for reuse as condensation water through the sprayer 20. A portion of the condensate-water mixture in the tank 17 is also pumped through a second line 23 to a second overhead sprinkler 24 located in the upper portion of the stack 12 below the condensate-water sprayer device 20. The pump $P_1$ in the line 21 works continuously while the pump $P_2$ of the line 23 only works during the condensate-water cooling process performed between the quenching operations.

When the hot condensate-water mixture is sprayed into the stack 12 in the time periods between the quenching operation, i.e., when the quenching car 11 is moved out of the interior 13 of the quenching tower 10, the doors to the quenching tower 14 are opened to permit air to enter and rise upwardly into the stack 12. The hot condensate-water mixture is sprayed through the sprinkler 24 and falls downwardly as droplets in the tower 12. The counterflowing cool air rising up the stack contacts the liquid droplets and cools the condensate-water mixture. Thus, it may be seen that between quenching operations, the quenching tower 1 operates, in effect, as a cooling tower for the cooling of the condensate-water mixture resulting from the earlier quenching of hot coke in the tower.

The quenching tower 10 has at the top thereof an air outlet opening 25 which is closed by flaps 26 during the quenching operation to prevent emission of the gases to the atmosphere during quenching of the coke, but which is opened during the condensate-water cooling operation to permit the updraft of air through the stack 12. The flaps 26 are controlled by means which are known to the art and therefore not illustrated to operate with the doors 27 such that the air outlet opening 25 is closed when the doors 27 are closed at the beginning of the coke quenching process and, conversely, opened when the doors are in their open position, as shown in FIG. 1, for cooling of the condensate-water. By virtue of the upward draft of cooling air between the quenching operations, the downwardly flowing drops of condensate-water mixture are uniformly cooled and mixed into tank 17 to provide the water to be used in the quenching operation. Only a very small amount of water is lost through the opening 25 in the top of the stack.

Figure 2:
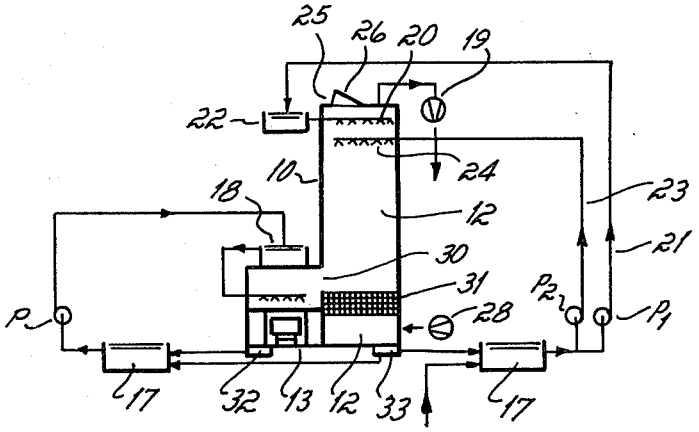
FIG. 2 is a schematic illustration of a second embodiment of the invention.

In the second embodiment of the invention shown in FIG. 2, the quenching tower 10 has the stack 12 displaced to the side of the interior 13 of the tower into which the quenching car moves. The interior 13 and the stack 12 are connected by means of a transverse shaft 30 above the quenching sprinklers 25. In this embodiment of the invention, the cooling of the condensate-water mixture and thus the condensate-water used for condensing the steam produced in the quenching operation may be increased by the addition of a cooling element 31, such as a heat exchanger, in the stack 12. The installation of the cooling element 31 is permitted by virtue of the lateral offset of the stack from the quenching car 11 which gives additional room for the cooling device 31. In addition, the device 31 is not located above the quenching car 11 and therefore not exposed to the heat radiated therefrom. In addition, the arrangement of the stack permits the separate withdrawal of the quenching water which is contaminated with coke dust from withdrawal of the condensate-water mixture. However, a portion of the cooled condensate-water mixture may be withdrawn and mixed with the quenching water in the tank 17 as needed.

In the embodiment shown in FIG. 2, the quenching water is collected in a collection device 32 located at the bottom of the quenching tower. A separate collection device 33 for collecting the condensate-water mixture is located at the bottom of the stack 12. From the collection device 33, the condensate-water mixture flows to a tank 17. Pump $P_2$ pumps a portion of the water in tank 17 to the condensate sprayer 24 while pump $P_1$ pumps a portion through line 21 to tank 22 for reuse as the condensate spray. Again, cooling of the condensate through activation of pump $P_2$ and spraying of the conduit from sprayer 24 takes place between quenching operations.

Figure 3:
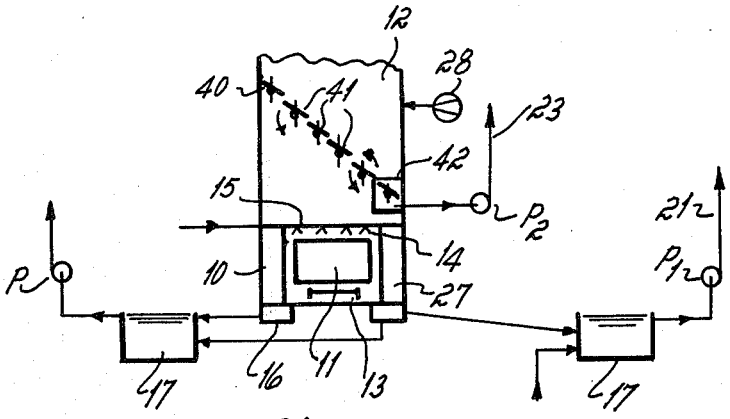
FIG. 3 is a schematic illustration with parts broken away of a third embodiment of the invention.

Referring now to FIG. 3, a third embodiment of the invention is shown. The upper portion of the quenching tower 10 is identical to that shown in FIG. 1 and therefore only the lower section of the tower 10 has been shown on a scale enlarged from that used in FIG. 1. In the embodiment shown in FIG. 3, flat slats 41 are mounted across the stack 12 above the sprinkler 15. The slats 41 are so mounted that when they are approximately at a horizontal position their edges overlap in a jalousie-like structure 40. The slats 41 are rotatable on their longitudinal axis. The slats 41 are located above the interior of the quenching tower into which the quenching car moves and above the sprinkler 15, but below the sprayers 20 and 24. As shown, the structure 40 is inclined to the vertical. Thus, the water sprayed from above collects on the slats 41, flows diagonally downwardly across the slats 41, and collects in a collection chamber 42. However, there is sufficient space between the slats to permit the passage of the steam generated in the quenching operation to rise upwardly in the stack 12 to be condensed above the structure 40.

The slats 41 located at the lower angle of inclination of the slat assembly 40, forms together with the wall of the stack 12 the condensate-water collection chamber 42. A line 23 is connected to chamber 42, and a pump $P_2$ in line 23 for directly conducting the condensate-water mixture to the sprayer 24. Thus, the mixture of condensation water and condensate falling downwardly in the steam-condensation process is accumulated on the slats 41 and flows downwardly across the individual slats 41 into the collection chamber 42 where the mixture accumulates. The pump $P_2$ in line 23, of course, remains shut off until condensate cooling begins. This affects a separation of the condensed condensate from the contaminated quenching water (from sprinkler 15) which is collected in the lower collection device 16 and accumulated in the intermediate tanks 17. On the completion of the quenching process, when the quenching car has been moved out of the quenching tower 10 and the doors 27 thereof opened, the plates 41 are swung around their longitudinal axes to their vertical position (shown in FIG. 3 in broken lines) to eliminate the overlap of the plates 41 and to give their widest possible separation therebetween for the cooling air flowing upwardly. At the same time, pump $P_2$ is turned on and the hot condensate-water mixture is pumped out of the chamber 42 through the pump line 23 into the sprayer 24 for spraying into the stack 12 where it is cooled by the counterflowing stream of air. At the same time, the other pump $P_1$ in the second line 21 connected to the intermediate tank 17 is turned off since only the cooling of the condensate-water mixture is being accomplished. As stated, the condensate-water mixture droplets falling down the stack 12 are cooled by the counterflowing stream of cooling air passing upwardly between the slats 41. The cooled water is collected at the bottom of the stack 12 in collection devices 16 where it is transferred to the intermediate tank 17 and mixed with the rest of the water supply.

If the cooling of the hot condensate-water mixture in one pass through the stack is not sufficient, the slats 41 may be partially closed so that sufficient cooling air passes upwardly between the slats 41 but the condensate-water mixture is picked up on the slats and again conducted to the collection chamber 42 where it is recirculated for further cooling. The other pump $P_1$ in the line 21 may also be turned on to provide spraying of the condensation water in tank 17 through the sprayer device 20 for further cooling.

The activation of the pump $P_2$ in line 23 connected to the collection chamber 42 as well as the movement of the slats 41 both into the substantially closed collecting position and the open vertical position is controlled simultaneously with the control of the opening and closing of the doors 27 and the air outlet flaps 26 either by hydraulic or pneumatically operated switches and cylinders or through suitably connected pressure lines. These kinds of control devices are well known to the art and their detailed description is consequently omitted.

In all three of the embodiments of the invention, the cooling of the condensate-water mixture may be increased by providing a ventilating device 28 through the wall of the stack 12 as shown in FIG. 3 for blowing in additional cooling air at the bottom of the stack during the cooling operation.

Although the invention has been described in terms of certain preferred embodiments, it will be appreciated that other forms may be adopted by those skilled in the art within the scope of the invention.

We claim:

1. In a process for the wet quenching of coke including the steps of introducing hot coke into a quenching tower, spraying the hot coke with water to quench the coke, and condensing the steam produced by spraying the hot coke with water with a water spray to form a condensate, the improvement comprising the steps of collecting the condensate, introducing at least a portion of the collected condensate into the quenching tower as a spray, and introducing an upwardly flowing stream of air into the quenching tower to cool the condensate sprayed in the quenching tower.

2. The process of claim 1 including the further steps of collecting the cooled condensate to provide the water spray for the condensing step.

3. The process of claim 1 wherein the collected condensate is introduced into the quenching tower in the upper portion thereof below the introduction of the condensing water spray.

4. The process of claim 1 wherein the cooled steam condensate is mixed with hot condensate and the mixture is circulated to the quenching tower to provide the condensing water spray.

* * * * *